United States Patent [19]

Casey et al.

[11] 4,391,026

[45] Jul. 5, 1983

[54] MILL ROLL

[75] Inventors: John A. Casey, San Francisco; Joseph C. V. Ducasse, Martinez, both of Calif.

[73] Assignee: Fabcon Incorporated, San Francisco, Calif.

[21] Appl. No.: 245,689

[22] Filed: Mar. 19, 1981

[51] Int. Cl.[3] ..... B21B 27/02

[52] U.S. Cl. ..... 29/121.6; 100/121; 100/176

[58] Field of Search ..... 29/121.6, 121.7; 100/121, 155 R, 176

[56] References Cited

U.S. PATENT DOCUMENTS

| | | | |
|---|---|---|---|
| 2,150,278 | 3/1939 | Hegenbarth | 29/121.7 X |
| 2,696,148 | 12/1954 | Hornbostel | 100/176 UX |
| 2,725,974 | 12/1955 | Shields | 29/121.7 X |
| 3,349,693 | 10/1967 | Mitchell, Jr. | 100/121 X |
| 3,969,802 | 7/1976 | Bouvet | 29/121.6 |

*Primary Examiner*—Howard N. Goldberg

*Attorney, Agent, or Firm*—Wenderoth, Lind & Ponack

[57] ABSTRACT

A mill roll includes a roll body, a plurality of circumferentially extending grooves formed in the periphery of the roll body, a plurality of channels extending axially through the roll body at positions inwardly of the grooves, a plurality of inserts fitted within the roll body at the radial bottoms of the grooves, and each insert having extending substantially radially therethrough an opening connecting the respective groove with a respective channel. Each opening has an elongated, substantially rectangular circumferential cross-section with a longer dimension extending substantially circumferentially of the roll body and a narrower dimension extending axially of the roll body.

6 Claims, 5 Drawing Figures

MILL ROLL

BACKGROUND OF THE INVENTION

The present invention relates to an improved mill roll for use in a mill for grinding material, such as sugar cane, and for extracting juice, for example sucrose, therefrom.

As is known in the sugar cane industry, the purpose of a cane mill is to grind sugar cane while extracting sucrose therefrom. A conventional cane mill includes a bottom roll and a top roll, the two rolls rotating in directions such that a blanket of sugar cane being nipped therethrough is ground. Sucrose extraction is achieved in conventional cane mills by providing "messchaert" grooves in the bottom rolls, such that as the cane blanket is nipped and ground between the two rolls, the sucrose juice is drained downwardly through the messchaert grooves. An inherent disadvantage of such conventional cane mills is the fact that a substantial amount of the extracted juice invariably becomes trapped in the upper part of the cane blanket and becomes reabsorbed during passage of the blanket between the two rolls.

One attempt to alleviate this conventional disadvantage is disclosed in U.S. Pat. No. 3,969,802, wherein the upper roll has formed in the periphery thereof a plurality of circumferentially extending grooves. A plurality of channels are formed within the body of the upper roll and extend axially thereof. A plurality of round holes extend substantially radially from the bottom of the grooves and communicate with the channels. Thus, during operation, juice at the upper part of the blanket is extracted by passing radially inwardly through the round holes and then axially through the channels. However, while this arrangement has been an improvement over previous cane mills, certain disadvantages exist. Thus, the round holes tend to become clogged. Furthermore, the manner of formation of the round holes, and subsequent repair or replacement thereof, is difficult.

SUMMARY OF THE INVENTION

With the above discussion in mind, it is a primary object of the present invention to provide an improved mill roll for use in a mill for grinding material, such as sugar cane, and for extracting juice, for example sucrose, therefrom, while overcoming the disadvantages of the prior art.

A more specific object of the present invention is to provide an improvement of the device disclosed in U.S. Pat. No. 3,969,802 and which overcomes the above noted disadvantages thereof.

The above objects are achieved in accordance with the present invention by the provision of a mill roll for use in grinding material such as sugar cane and for extracting juice therefrom, such mill roll including a roll body, a plurality of circumferentially extending grooves formed in the periphery of the roll body, and a plurality of channels extending axially through the roll body at positions inwardly of the grooves. A plurality of inserts are fitted within the roll body at the radial bottoms of the grooves. Each such insert has extending substantially radially therethrough an opening connecting the respective grooves with a respective channel. Each opening has an elongated, substantially rectangular circumferential cross-section with a longer dimension extending substantially circumferentially of the roll body and a narrower dimension extending axially of the roll body.

The cross-sectional area of each opening increases in a direction substantially radially inwardly of the roll body.

Each opening is defined by a pair of axially spaced generally circumferentially extending walls and a pair of circumferentially spaced generally axially extending walls. The pair of generally circumferentially extending walls diverge in a direction radially inwardly of the roll body. The pair of generally axially extending walls extend in parallel generally radial directions.

Each circumferentially extending groove is in the form of a substantially V-shaped groove defined by a pair of facing flank surfaces which converge radially inwardly of the roll body. For each insert there is provided a substantially radially extending recess formed in at least portions of the facing flank surfaces of the respective groove. Such recess extends inwardly of the bottom of the groove, with the insert fitting within the recess. Welds secure the insert within the recess, such welds filling-in portions of the recess formed in the flank surfaces and reforming such flank surfaces.

Preferably, each recess is circular, and the respective insert has a circular exterior configuration which is complementary to the recess. A circular hole extends substantially radially inwardly from each recess to the respective channel. The diameter of the circular hole is less than the diameter of the radius. The respective opening is defined by a pair of axially spaced generally circumferentially extending walls which diverge from each other in a direction radially inwardly of the roll body from the radially innermost portions of the welds. The opening is further formed by a pair of circumferentially spaced generally axially extending walls which are aligned with spaced portions of the inner peripheral wall of the respective hole.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Although the following description will be with reference to a mill roll for use in a cane mill for the grinding of sugar cane and for the extraction of sucrose juice therefrom, it is to be understood that such use is a preferred use and that the present invention might well be employed for the grinding of other materials and the extraction of juice therefrom.

Furthermore, it is to be understood that the present invention is an improvement over the invention of U.S.

Pat. No. 3,969,802, and the disclosure of such U.S. Patent is hereby incorporated by reference.

Figure 1:
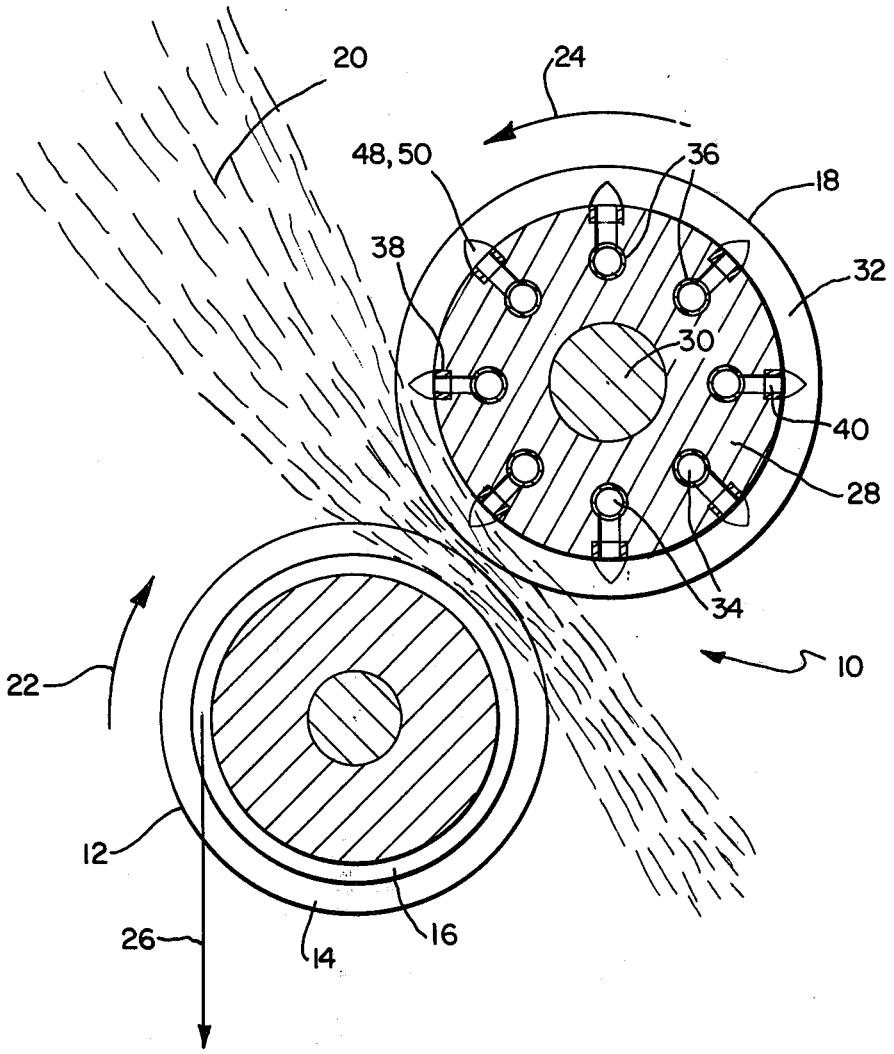
FIG. 1 is a somewhat schematic cross-sectional view through a cane mill employing a mill roll according to the present invention.

As shown in FIG. 1, a cane mill 10 includes a known lower roll 12 having formed in the periphery thereof a plurality of grooves 14, for example substantially V-shaped grooves, from the bottom of which extend messchaert grooves 16. The cane mill 10 further includes an upper roll in the form of the novel mill roll 18 of the present invention, to be discussed in more detail below. A blanket of sugar cane 20 is continuously fed into the cane mill 10, with rolls 12 and 18 rotating in the directions indicated by arrows 22 and 24, respectively. This will result in grinding of the sugar cane and drainage of a portion of the juice therefrom in a conventional manner via messchaert grooves 16, as indicated by arrow 26. However, that portion of the juice at the upper part of the cane blanket will be extracted by means of the novel mill roll 18 of the present invention.

With more particular reference to the various figures of the drawings, the mill roll 18 of the present invention includes a roll body 28 which is rotated by a shaft 30 which may be formed separately as illustrated in the drawings or which might be formed integral which roll body 28.

Roll body 28 has formed in the periphery thereof a plurality of circumferentially extending grooves 32. Preferably, grooves 32 are substantially V-shaped grooves which extend around the entire periphery of the roll body 28.

Body 28 also has formed therein a plurality of channels 34 which extend axially throughout the entire length of roll body 28 at positions inwardly of the grooves 32. Channels 34 are formed to be substantially burr-free. In a preferred arrangement, channels 34 may be formed by tubes 36 which are integrally cast with the roll body 28.

Figure 2:
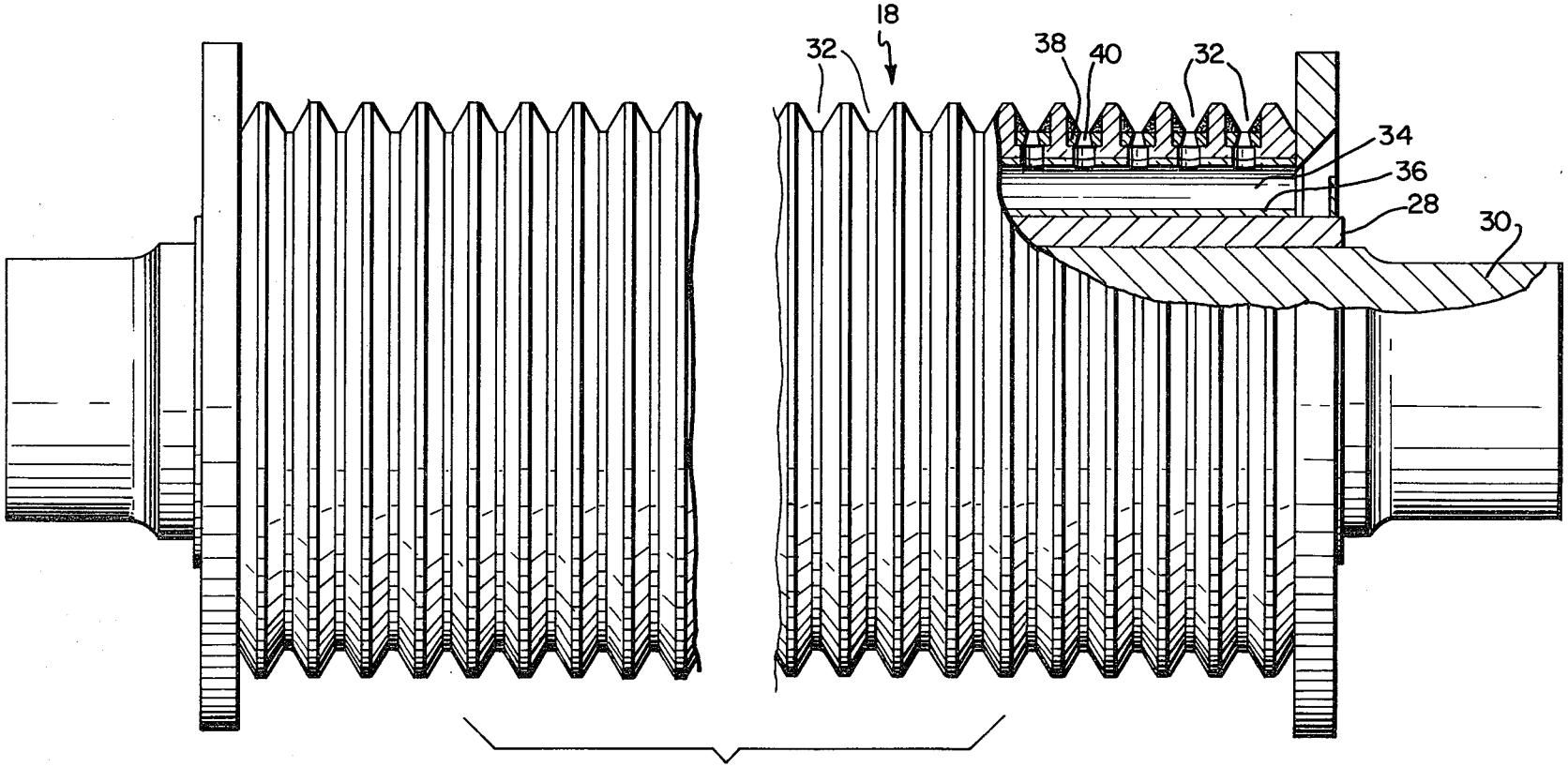
FIG. 2 is an elevation view, partially broken away and partially in section, of the mill roll of the present invention.

A plurality of inserts 38 are fitted within the roll body 28 at the radial bottoms of the grooves 32. Each insert 38 has extending substantially radially therethrough an opening 40 connecting the respective groove 32 with a respective channel 34. Thus, the inserts 38 and openings 40 are arranged in axially extending rows, as will particularly be apparent from FIGS. 1 and 2 of the drawings. FIG. 1 schematically illustrates eight such rows. However, it is to be understood that this is exemplary only and not limiting to the scope of the present invention, inasmuch as a particular installation may be designed to have any desired number of such rows.

In accordance with a particular novel feature of the present invention, the openings 40 are not merely round, but are elongated in the circumferential direction of the roll body 28. Specifically, in the preferred illustrated arrangement, each opening 40 has an elongated, substantially rectangular circumferential cross-section with a longer dimension extending substantially circumferentially of the roll body 28 and a narrower dimension extending axially of the roll body 28. As will be particularly apparent from the enlarged views of FIGS. 3 and 4, the cross-sectional area of each opening 40 increases in a direction substantially radially inwardly of the roll body, such that the radially outermost portion of the opening 40 has the smallest cross-sectional area. The provision of the openings 40 as being elongated in the circumferential direction of the roll body unexpectedly results in less clogging than the round holes disclosed in U.S. Pat. No. 3,969,802. The radially outermost portion of opening 40 has dimensions a preferably equal to $\frac{1}{2}''$ to $1''$, further preferably approximately $\frac{3}{4}''$, and b preferably equal to $\frac{1}{8}$ to $\frac{1}{4}''$, further preferably $3/16''$.

Figure 3:
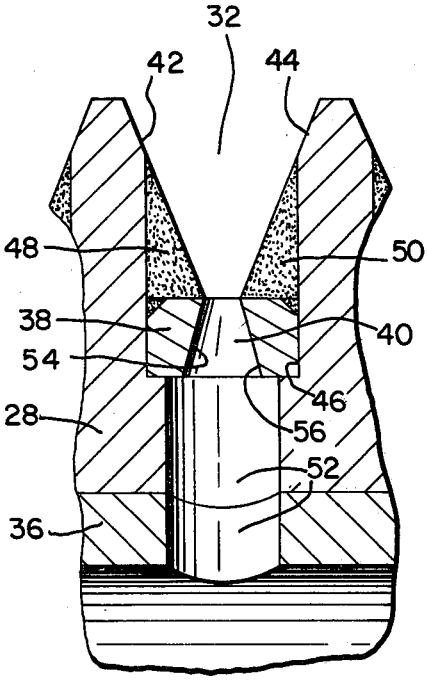
FIG. 3 is an enlarged cross-sectional view of a portion of FIG. 2.

As shown particularly in FIG. 3 of the drawings, each V-shaped groove 32 is defined by a pair of facing flank surfaces 42 and 44 which converge radially inwardly of the roll body 28. For each insert 38 there is formed a substantially radially extending recess 46. Recess 46 is formed in at least portions of the facing flank surfaces 42 and 44, and recess 46 extends inwardly of the bottom of the respective groove 32. Insert 38 fits within its respective recess 46. Specifically, when assembling the mill roll of the present invention, after the formation of the respective recesses 46, the inserts 38 may be inserted by sliding into the respective recesses. When the inserts 38 are in place within the respective recesses 46, welds 48 and 50 are formed to secure the inserts 38 within their respective recesses 46. Welds 48, 50 are formed to fill-in the portions of the recesses 46 which are previously formed in the respective flank surfaces 42, 44. The formation of welds 48, 50 thereby reforms the flank surfaces 42, 44, respectively, as particularly shown in FIG. 3 of the drawings. Welds 48, 50 cover substantially the entire radial outer surface of insert 38, except for opening 40 therethrough, thus protecting the radial outer edges of opening 40 from abrasion.

Figure 4:
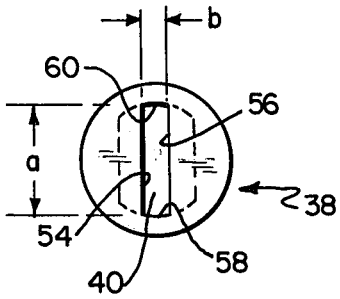
FIG. 4 is a plan view of an insert employed in the mill roll of the present invention.
Figure 5:
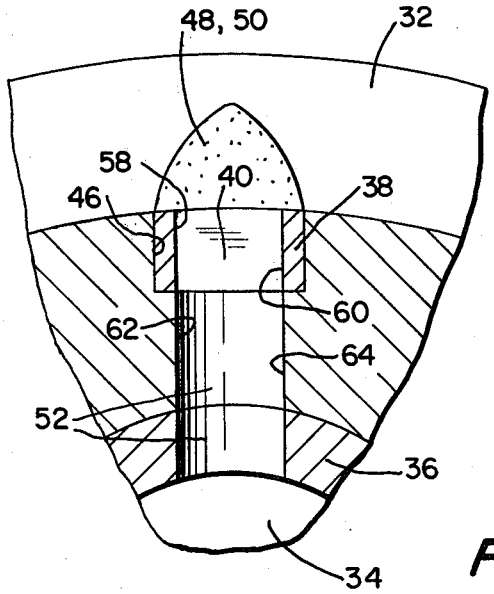
FIG. 5 is a partial cross-sectional view taken along a plane extending at a right angle to the plane of FIG. 3.

Preferably, each recess 46 is circular, and each insert 38 has a circular exterior configuration, as particularly shown in FIG. 4, which is complementary to the respective recess 46. A circular hole extends substantially radially inwardly from each recess 46 to the respective channel 34. Hole 52 thus extends inwardly through roll body 28 and the respective tube 36. The diameter of hole 52 is less than the diameter of recess 46, and the step formed therebetween is abutted by the innermost surface of the insert 46. As particularly shown in FIGS. 3–5, each opening 40 is defined by a pair of axially spaced generally circumferentially extending walls 54, 56 which diverge from each other in a direction radially inwardly of roll body 28 from radially innermost portions of welds 48, 50. Opening 40 is further defined by a pair of circumferentially spaced generally axially extending walls 58, 60 which are aligned with spaced portions 62, 64 of the inner peripheral wall of hole 52.

Returning now to FIG. 1 of the drawings, upon operation of a cane mill including a mill roll 18 of the present invention, it will be apparent that juice which is at the upper part of the cane blanket nipped between the upper and lower rolls will be extracted through openings 40 in directions radially inwardly of roll 18, and will then be extracted through channels 34 in directions axially of the roll body. Due to the circumferentially elongated configuration of openings 40, clogging will be substantially eliminated.

Furthermore, due to the novel assembly and configuration of inserts 38 and welds 48, 50, replacement of the inserts is substantially simplified.

The inserts 38 must be made of a material which will withstand wear from corrosion and abrasion, yet which will be machinable to allow for replacement of the inserts. A preferred material for inserts 38 is a hard high-chrome alloy steel, for example such a steel including 10 to 14% chrome. It will however be understood by those skilled in the art that other materials having the necessary properties may be employed. It will further be apparent that the welds 48, 50 must be able to withstand wear from corrosion and abrasion, but yet must also be machinable to allow for replacement of the inserts. Preferably, welds 48, 50 are formed by employing stainless steel hardfacing welding electrodes. It is believed that those skilled in the art will readily understand what materials may be employed to form welds 48, 50.

Although the present invention has been described and illustrated with regard to a preferred embodiment thereof, it is to be understood that various modification may be made without departing from the scope of the present invention. Furthermore, it is to be understood that other modifications which are conventional in the art may be made to the configuration of the mill roll of the present invention, as long as the fundamental novel features of the present invention, as described herein, are not obviated. For example, the exterior surface of the mill roll 18 may be provided with cross grooves of the "chevron" or "kay" type.

We claim:

1. A mill roll for use in grinding material such as sugar cane and for extracting juice therefrom, said mill roll comprising:

a roll body;

a plurality of circumferentially extending grooves formed in the periphery of said roll body, each said circumferentially extending groove comprising a substantially V-shaped groove defined by a pair of facing flank surfaces which converge radially of said roll body;

a plurality of channels extending axially through said roll body at positions inwardly of said grooves;

a plurality of radially extending recesses formed at locations spaced circumferentially around each said groove, each said recess being formed in at least portions of said facing flank surfaces of the respective said groove, and each said recess extending inwardly of the bottom of said respective groove;

a plurality of inserts, each said insert being fitted within a respective said recess, and each said insert being secured in the respective said recess by welds filling-in portions of said recess in said facing flank surfaces and reforming said flank surfaces;

each said insert having extending substantially radially therethrough an opening connecting the respective said groove with a respective said channel, each said opening having an elongated, substantially rectangular circumferential cross-section with a longer dimension extending substantially circumferentially of said roll body and a narrower dimension extending axially of said roll body; and said welds covering substantially the entire radial outer surface of the respective said insert, except for said opening therethrough, such that said welds protect the radially outer edges of said opening.

2. A mill roll as claimed in claim 1, wherein the cross-sectional area of each said opening increases in a direction substantially radially inwardly of said roll body.

3. A mill roll as claimed in claim 1, wherein each said opening is defined by a pair of axially spaced generally circumferentially extending walls and a pair of circumferentially spaced generally axially extending walls.

4. A mill roll as claimed in claim 3, wherein said pair of generally circumferentially extending walls diverge in a direction radially inwardly of said roll body, and said pair of generally axially extending walls extend in parallel generally radial directions.

5. A mill roll as claimed in claim 1, wherein said recess is circular, and said insert has a circular exterior configuration which is complementary to said recess.

6. A mill roll as claimed in claim 5, further comprising, for each said opening, a circular hole extending substantially radially inwardly from said recess to the respective said channel, the diameter of said hole being less than the diameter of said recess, and wherein said opening is defined by a pair of axially spaced generally circumferentially extending walls and by a pair of circumferentially spaced generally axially extending walls, said pair of generally circumferentially extending walls diverging from each other in a direction radially inwardly of said roll body from radially innermost portions of said welds, and said pair of generally axially extending walls being aligned with spaced portions of the inner peripheral wall of said hole.

* * * * *